United States Patent [19]

Eriksson

[11] 4,252,663

[45] Feb. 24, 1981

[54] DETERGENT COMPOSITIONS

[75] Inventor: Georg T. Eriksson, Jakobsberg, Sweden

[73] Assignee: AB Helios, Kemisk-Tekniska Fabriker, Stockholm, Sweden

[21] Appl. No.: 466,297

[22] Filed: May 2, 1974

Related U.S. Application Data

[63] Continuation of Ser. No. 216,825, Jan. 10, 1972, abandoned.

[30] Foreign Application Priority Data

Jan. 15, 1971 [SE] Sweden ..... 443/71

[51] Int. Cl.[3] ..... C11D 3/20; C11D 3/395; C11D 7/26

[52] U.S. Cl. ..... 252/99; 252/135; 252/527; 252/546; 252/DIG. 11; 252/DIG. 12

[58] Field of Search ..... 252/89, 102, DIG. 1, 252/95, 99, 135, 527, 529, 541, 543, 544, 546, 548, DIG. 11, DIG. 12, DIG. 14

[56] References Cited

U.S. PATENT DOCUMENTS

| | | | |
|---|---|---|---|
| 2,817,606 | 12/1957 | Barrett | 134/22 R |
| 3,194,768 | 7/1965 | Lindner et al. | 252/186 |
| 3,457,176 | 7/1969 | Huggins | 252/135 |
| 3,590,001 | 6/1971 | Taylor et al. | 252/526 |
| 3,658,727 | 4/1972 | Mast | 252/538 |
| 3,661,787 | 5/1972 | Brown | 252/109 |
| 3,692,684 | 9/1972 | Hentschel | 252/89 |
| 3,741,911 | 6/1973 | Shane | 252/527 |
| 3,749,675 | 7/1973 | Chang | 252/135 |

FOREIGN PATENT DOCUMENTS

| | | |
|---|---|---|
| 853647 | 10/1907 | Canada . |
| 176986 | 10/1961 | Sweden . |

OTHER PUBLICATIONS

*The Condensed Chemical Dictionary*, 8th ed., 1971, p. 780.

Davidsohn et al., *Synthetic Detergents*, Leonard Hill Pub., London, 1967, p. 31.

*Primary Examiner*—Bruce H. Hess

*Attorney, Agent, or Firm*—Frishauf, Holtz, Goodman & Woodward

[57] ABSTRACT

The present invention provides a detergent composition, comprising surface active agents and fillers and builders, characterized in that it is free or substantially free from components which are sensitive to calcium and/or magnesium ions. In detail, the composition contains (i) between about 0.5 and 95% of one or more electrically neutral, polar surface active agents and/or carboxylic acids, condensed with ethylene and/or propylene oxide, and (ii) between about 0.5 and 98% of fillers and builders which do not react with calcium or magnesium ions to form compounds which precipitate as solids or become adsorbed on the surface of a substrate being washed during cleaning or rinsing when said detergent composition is used to wash said substrate.

31 Claims, No Drawings

DETERGENT COMPOSITIONS

This is a continuation of application Ser. No. 216,825, filed Jan. 10, 1972 now abandoned.

BACKGROUND OF THE INVENTION

A modern detergent is a complicated mixture of a great number of different compounds. The major part of these can be assigned to the groups (i) surfactants, i.e. surface active agents, and (ii) builders, which to a large extent consist of chelating agents. The builders alone have no or little washing power. However, they strongly increase the efficiency of the surface active agents.

The knowledge of the interraction between the surface active agents and the chelating agents has been empirical. The present invention is concerned with an amplification of the conventional washing theory and considers the interaction between builders and surface active agents. It also presents teachings which can be used to provide washing, dishwashing and cleaning agents with new and from many points of view surprising properties without having to use substances which can be considered suspicious from the views of corrosion, toxicity and pollution.

An ideal detergent should have the following objectives:

1. It must be nontoxic both to the production workers and to the consumer.
2. It should have good detergency.
3. It should, independent of the properties of the diluting agents, give consistently good results.
4. It should not, during the cleansing procedure or when the cleaning solution is diluted, give adverse subsidiary effects (e.g. precipitation of insoluble compounds on or in the textile fibres).
5. It should be biologically degradable.
6. It must not damage the materials, machines or instruments used with the detergent.
7. The degradation products produced must not be toxic or otherwise disturb the ecological balance.
8. The supply of raw materials at acceptable prices should be good.

The largest group of cleaning agents in accordance with the present invention is the clothes washing agents. The situation today in relation to the above mentioned objectives follows: dominant part of the washing agents can be divided into the following main classes with reference to the builders:

I. phosphate based
II. NTA (nitrilotriacetic acid) - based
III. based on substitutes for phosphate other than NTA These above mentioned three classes can all, with reference to the content of surface active agents, be divided into the following subdivisions:

A. based on soaps
B. based on synthetic anionic surface active agents
C. based on nonionic surface active agents
D. based on mixtures of two or three of the above groups A, B and C As to the subdivisions, it can be pointed out that Group A in particular does not fulfill the points 2, 3 and 4 of the afore-listed objectives. Soap is a very effective complexing agent for the hard water components, i.e., the divalent calcium and magnesium ions usually referred to herein as "$Ca^{2+}$" and "$Mg^{2+}$". As a consequence during washing in hard water, insoluble lime soaps are formed which remain in the washed textile material and render it rough and give it a hard or coarse feel after repeated washing. Even if complexing agents with larger stability constants than those of the soap, which is not practically applicable today, were admixed with soap in the detergent, lime soaps would be formed.

The surface active agents of group B are also somewhat sensitive to hardness formers, however to a considerably lesser degree than are the soaps. Most of the surface active agents for sale today are biologically degradable. The rate of degradation however varies within very wide limits.

The surface active agents of Group C contain some agents which are little or not at all biologically degradable. The group also contains others which are entirely biologically degradable, e.g. alkyl ethylene oxide condensates.

Group D has primarily the same disadvantages and advantages as the compounds of the mixture individually, except for one respect, namely the washing effect. An increase of the washing effect can be obtained through mixing different types of surface active agents.

The following applies with reference to the head Classes I, II and III:

I. Phosphate has a nourishing (fertilizing) effect on algae growth. Uncontrolled discharge of phosphate rich waste water causes the receiving body to be choked with algae. During the growth of algae, oxygen is consumed and gradually all organic life in the overfertilized receiving body dies. The phosphate is usually present in the detergents in the form of tripolyphosphate. This provides within certain limits soluble compounds with the hard water components, but when diluted during the rinsing the lower concentration limit for forming soluble compounds is passed, and precipitation of insoluble Ca- and/or Mg-phosphates occur in variable amounts in the washed textile, which thereby become rough and feel "hard".

II. NTA is used as a substitute for phosphate in detergents, among other things, in order to reduce the outlet of phosphates in the waste water. The question of the eventual negative biological effects of NTA is not finally established but is still being discussed. NTA is such a strong chelating agent for heavy metals that certain measures have to be taken (described in the British Pat. No. 1.162.090) to protect elements, bearings and similar details of Cu- or Zn-alloys from corrosion. NTA-detergents usually also contain a certain amount of phosphates which means that they still to a certain degree contribute to the nourishment of the bodies of water.

III. The only commercially used substitute for phosphates today which falls under this group is sodium citrate. This compound is biologically degradable. It does not damage washing machines and the like and it is nontoxic. Detergents based on sodium citrate give satisfactory washing results in normal waters. Unfortunately, the citrate based detergents for sale up to now have a big disadvantage.

When washing in medium hard and hard waters significant amounts of insoluble salts of hard water components are precipitated in the washed textiles during the rinsing. The amount of precipitate is in many cases ten times greater than when using phosphate- or NTA-based detergents. This means that the citrate based detergents can not be used advantageously except in rather soft water. Furthermore, citrate is not a very attractive raw material for detergent manufacture, as the supply of citrate is limited and consequently the prices rather high.

For an analysis of the cleaning process we can imagine surfaces (textile fibres, china, etc.) soiled with different substances. These can be soluble or insoluble in water. In this connection we do not have to worry about the water soluble substances as we are talking of wet cleaning. The water insoluble soil (dirt) can be a grease film or particles. Coarse particles do not cause any trouble either as they are weakly adherent and will be removed mechanically. Thus the cleaning process can be analysed by studying the interaction between surface active agents, grease, fibre surfaces (or other surfaces which are to be cleaned) and small particles. The present invention aims to present detergents which in their preferred forms accomplish all the above mentioned objectives.

As a rule, cleaning solutions contain relatively high proportions of surface active agents which are above the critical concentration for micelle formation, i.e., the surface active agents are present in the form of micelles.

The micelles are thought to adhere to every available surface and partly to even force their way into fibres, and between fibres and particles. The micelles will dissolve fatty soil (dirt) which in this way is loosened and emulsified.

Between all particles, emulsion drops and other free surfaces, powers of repulsion occur and also steric obstacles due to the thickness of the hydrophilic layer. In this way the loosening and separation of fatty (dirt) soil, as well as small particles from the surface which is to be cleaned, can be explained theoretically based on the so-called electrokinetic- or Z-potential between different surfaces in the cleaning solution.

The state of the formed micelle layer is, as are all physico-chemical states, not static but dynamic, so a small portion of the $Ca^{2+}$ and/or the $Mg^{2+}$-ions can force their way forward to the fibre surfaces and become bound to the polar groups thereof.

The anionic surface active agents, because of their ionic character, render the important effect of imparting negative charges to the surface (substrate), while on the other hand, the non-ionic surface active agents impart a negligible addition of charge to the surface. The $Ca^{2+}$ and/or $Mg^{2+}$-ions have the serious effect of neutralizing such charges. This acts to reduce the forces of repulsion between the micelles. This makes it possible for the Van der Waals forces to maintain the dirt affixed to the substrate. To prevent this, it has been necessary when using available detergents to use substances with large stability constants for $Ca^{2+}$ and/or $Mg^{2+}$ complexes in order to lower the proportion of free $Ca^{2+}$ and/or $Mg^{2+}$-ions in the cleaning solution. In spite of that there is, as described above, precipitation on textile fibres and the like during rinsing, when the proportion (concentration) of the substance with power to chelate $Ca^{2+}$ and/or $Mg^{2+}$ is not sufficiently high.

During the washing process the fibres swell because of the influence of water and alkali. A portion of the fibre becomes amorphous. The amorphous substrate is connected with the surface of the fibre by narrow pores. On these surfaces negative ions (anions) are adsorbed, preferably those having a small ionic radius. There are steric obstacles to cationic—and larger anionic ions—the cationic ions because of the fact that they are surrounded by a firmly bound water layer.

The tendency of the negative ions to become adsorbed can be described in different ways. One way is for example Hofmeister's lyotropic series which is applicable to neutral solutions:

$$F^-, ClO_4^-, SO_3^{2-}, CO_3^{2+}, PO_4^{3-}, OH^-, NO_3^-, Br^-, HS^-, J^-, SCN^-, S^{2-}$$

There is, from left to right, increasing molecular polarization, adsorption and peptization power, as well as reducing coagulating power.

In today's detergent solutions the most common negative ion is $CO_3^{2-}$ which in many cases is a component of the detergent. Additionally it is a component of hard water. In the latter case it is present as $HCO_3^-$-ion which under the influence of alkali and/or of heat is converted into $CO_3^{2-}$-ion. The positive counterions of the negative ions during the washing process mostly consist of alkali metal ions such as $Na^+$ which, due to earlier mentioned reasons, do not enter the inner structure of the fibre.

During the rinsing, the counterions are to a great extent exchanged by $Ca^{2+}$ and $Mg^{2+}$ coming from the hard water. When the anions due to diffusion have reached the fibre surface or parts of the fibre, where they can react with $Ca^{2+}$- and $Mg^{2+}$-ions, crystals are formed, which to a great extent stay in the fibre or between different fibres. The condition for crystal formation is of course that the negative ions are such as to give insoluble salts with $Ca^{2+}$ and $Mg^{2+}$ (e.g. $CO_3^{2-}$).

As a summing up, it can be said that the greatest drawback to washing, dishwashing and cleaning agents of today, i.e., their hard water sensitivity, can be eliminated if the amount of $CO_3^{2-}$ and negative ions like it, which give insoluble $Ca^{2+}$ and/or $Mg^{2+}$ salts, is reduced to a minimum in the detergent composition. The negative ions which instead are incorporated need not be strong chelating agents of $Ca^{2+}$ and $Mg^{2+}$.

SUBJECT MATTER OF THE INVENTION

The detergent compositions of the present invention broadly have the following composition:

0.5–95% Neutral polar surface active agents specified in (i).

0.5–98% Under (ii) described, fillers and builders which are not sensitive to $Ca^{2+}$ and/or $Mg^{2+}$.

0–15% Inorganic and/or organic chelating agents such as described under (iii) hereinafter.

0–50% Components usually incorporated in detergents, such as bleaching agents, anti-redeposition agent, optical bleaches, peroxide stabilizers, accelerators, enzymes, etc.

0–90% Water.

All parts and percentages herein are by weight.

(1) The surface active agents should entirely or mainly be constituted of electrically neutral polar surface active agents and/or carboxylic acids condensed with ethylene and/or propylene oxide. Examples of electrically neutral, polar surface active agents include aliphatic, aromatic or alkylaromatic compounds condensed with ethylene oxide and/or propylene oxide, condensates of ethylene oxide with hydrophobic base formed by condensing propylene oxide and propylene glycol (commonly known as Pluronics), carbohydrate derivatives condensed with ethylene and/or propylene oxide, reaction products between alkylene ethylenediamine and ethylene and/or propylene oxide, mono-or diethanolamide of fatty acids, phosphine oxide, amine oxide with a carbon chain of more than 8 carbon atoms and Zwitterionic compounds. Of the afore-specified electrically neutral polar surface active agents, a nonionic surface active agent of the aliphatic ethoxylated type is preferred, e.g., the Pluronic series of nonionic agents marketed by Wyandotte Chemicals Corp. and being a series of condensates of ethylene oxide with hydrophobic bases formed by condensing propylene oxide with propylene glycol.

(ii) As a principle all negative ions, which do not precipitate with the hard water components or whose precipitate is readily dissolved or dispersed during the rinsing at the concentrations of $Ca^{2+}/Mg^{2+}$ that exist in these washing, dishwashing or cleaning solutions, may be used as builders. Examples of suitable ions follow: ions of toluene sulphonate, xylene sulphonate and similar sulphonates which do not give insoluble $Ca^{2+}$ and/or $Mg^{2+}$-compounds,

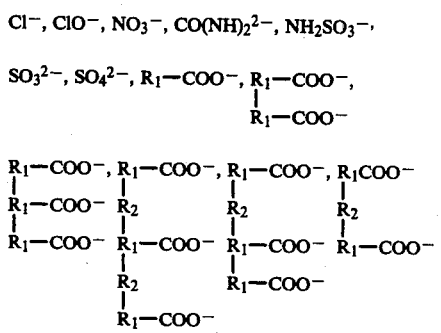

where $R_1$ is H, CH, $CH_2$, $CH_3$, $C_nH_{2n-x}$, $C_nH_{2n-x}Z_y$, Z can be OH, $NH_2$, $NHR_1$, $SO_3Me$, $C_nH_{2n+1-x}$, an ether group (C—O—C), halogens, phenols, ethylene oxide, propylene oxide, y can range from 1 to 50, $R_2$ can be $C_nH_{2n}$ and $C_nH_{2n-x}$, n can range from 1 to 22, x from 0 to 10 and Me can be $H^+$, $Na^+$, $K^+$, $Li^+$, $(NH_4)^+$, $Mg^{2+}$, $Ca^{2+}$. The described compounds can exist either free or as salts of alkali metals, ammonium, organic bases or also as partially or completely esterified mono-, di-or polyalcohols. The compounds can also exist substituted with aliphatic and/or aromatic compounds of different kinds. To this group may also belong other types of organic substances, like disaccharides, ethylene and propylene glycols, polyethylene and polypropylene glycols with a molecular weight of 200–6000, ethylene, propylene and butylene glycol ethers, paraffinic hydrocarbons with a carbon chain of 8–30 carbon atoms and mono-, di- or trialcohols with a carbon chain of 1–18 atoms. Preferably xylene and toluene sulphonates, glycol ethers, polyethylene glycol, and alkali metal - or ammonium salts or salts of organic bases of mono- or dicarboxylic acids are used.

(iii) The organic and/or inorganic chelating agents are in themselves not necessary for the function of the system, but could for various reasons be added in small amounts. These may be, for example, phosphonic acid compounds, polyphosphates, aminopolycarboxylates such as NTA and EDTA, starch derivatives i.e., partially oxidized starch, polymers or copolymers of carboxylic acids with olefins or aminocompounds.

The detergent compositions of the invention do not (or only in small amounts) contain $Ca^{2+}$ and/or $Mg^{2+}$ precipating ions. With a detergent composition according to the invention, the negative ions which go into the fibre mostly are $OH^-$ ions. The counter ion film is, as mentioned hereinbefore, mostly made up of $Na^+$ ions.

The detergent compositions according to the invention exhibit to a greater extent than do conventional detergents, a special synergism between the surface active agents and the other components of the detergent composition.

The size of the hydrophilic part of the surface active agents described under (i) provide a large micelle with relatively weak surface charge. Because of this $Ca^{2+}$ and/or $Mg^{2+}$-ions can not bind a micelle to another micelle or a micelle to a solid surface so strongly that sufficiently stable $Ca^{2+}$ and/or $Mg^{2+}$ bonds are made. Such bonds would cause a poor washing result.

As noted hereinbefore, available free $Ca^{2+}$ and/or $Mg^{2+}$-ions can to a certain extent reach the surfaces and be bound to other polar groups of these surfaces. Therefore it is essential that the $Ca^{2+}$ and/or $Mg^{2+}$-ions have as counter-ions negative ions which on one hand do not give insoluble compounds with the hard water components and on the other hand maintain the equilibrium in the cleaning solution between $Ca^{2+}$ and/or $Mg^{2+}$-ions and counterions. In cleaning solutions, according to the invention, the counterions mostly are such ions as described under b/ above. As a consequence of the use of these precipitates of $Ca^{2+}$ and/or $Mg^{2+}$ with the $CO_3^{2-}$ ions (made from $HCO_3^-$ through influence of heat and alkali as described hereinbefore) is prevented.

During rinsing, the steric obstacle of micelles bound to the surfaces disappears due to dilution. In a conventional detergent solution the remaining quantities (concentration) of chelating agents during the rinsing is not sufficient to chelate the $Ca^{2+}$ and/or $Mg^{2+}$-ions brought in by the rinsing water. These are therefore bound to the polar groups - according to the theories of ion exchange - of the textile surfaces, and the washed textiles then contain a certain amount of bound $Ca^{2+}$ and/or $Mg^{2+}$-ions. These ions give insoluble carbonate precipitates together with the $CO_3^{2-}$-ions, which are made through alkalizing of the $HCO_3^-$-ions, added by the rinsing water. The strong buffering capacity which conventional detergents have make this above described insoluble carbonate precipitates continue during most of the following rinses.

If on the other hand a detergent according to the invention is used, the fibres have adsorbed negative ions from the fillers and builders under (ii) above, during the washing process. The fact that these negative ions preferably are adsorbed on to the fibre is partly due to their high concentration in the washing solution in relation to other negative ions and partly to their greater affinity to the fibre.

Negative ions of this kind diffuse sufficiently slowly from the fibre during the rinsing to block the polar groups of the fibre, thus preventing formation of insoluble hard water salts on the fibre surface. This can be illustrated more closely by the following figure, where as example of the ions described under (ii) a carboxylic acid is chosen and as example of polar group of the fibre surface carboxyl:

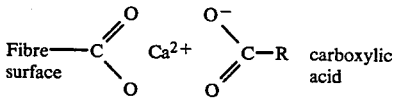

Detergents according to the invention also have small buffering capacity, so that practically no $CO_3^{2-}$-ions are produced during rinsing.

When washing with a detergent according to Example 7 hereinafter, the pH was 9.7 in the washing solution, 9.1 in the first rinsing water, 8.5 in the second rinsing water, 8.3 in the third and 8.2 in the fourth. The water used for washing and rinsing had a pH of 8.2. It is clear that the substances that are preferred for the detergents according to the invention and are named under (i) and (ii) above are nontoxic and biologically degradable and that their biodegradation products can not disturb the ecological balance.

The detergent compositions preferably contain between about 0.5% and 90% of said non-ionic polar surface active agent. Preferred composition contains, as said component (ii), at least one compound selected from the group consisting of xylene and toluene sulphonates, glycol ethers, polyethylene glycol, salts of mono and di-carboxylic acids, said salts being selected from the alkali metal salts, the ammonium salts and the esters formed with organic bases which hydrolize in water to yield the anion of said carboxylic acid.

The compositions preferably contain said surface active component (i) in an amount between about 0.5% and 35%, and more preferably between 5% and 30%, and said filler and builder component (ii) in an amount between about 10% and 65%.

Preferred surface active agents are: the non-ionic surface active agent selected from the group consisting of the long chain (12–20 carbon atoms) fatty alcohols and carboxylic acids condensed with 8–30 moles of propylene and/or ethylene oxide, and condensates of ethylene oxide with hydrophobic bases formed by condensing propylene oxide with propylene glycol, preferably in an amount between 5% and 30% of the total detergent composition; and the builders and fillers are preferably in an amount between 5% and 50%.

Other preferred compositions include those containing the components specified as being preferred herein, e. g., those in the preceeding paragraph, and also the following:

A. A detergent composition comprising between 5% and 30% of a fatty alcohol polyglycol either condensed with ethylene oxide containing 12–20 carbon atoms in the alcohol chain and between 8 and 30 moles of ethylene oxide, as the surface active agent, and between about 10% and 65% of at least one carboxylic acid salt containing 2–12 carbon atoms as the builder.

B. Any of the preferred compositions wherein said composition is a solid admixture of between about 15% and 30% of said surface active agent, and between about 20% and 50% of said carboxylic acid salts.

C. Any of the preferred compositions wherein said surface active agent contains an average of between 16 and 17 carbon atoms in the alcohol chain and an average of between 9 and 20 moles of ethylene oxide, and wherein said carboxylic acid salt includes a major portion of a dicarboxylic acid salt containing 4–10 carbon atoms.

D. Any of the preferred compositions containing between about 10% and 20% of percarbamate.

E. Composition A hereinbefore noted wherein said composition is a liquid detergent and contains as the major active components, between about 5% and 25% of a fatty alcohol polyglycol ether condensed with ethylene oxide containing 12–20 carbon atoms in the alcohol chain and between 8 and 30 moles of ethylene oxide.

F. The preferred compositions (preferably liquid) containing between about 2% and 10% of an alkylolamide.

G. Any of the preferred compositions wherein the component (ii) is selected from the group consisting of toluene sulphonate and xylene sulphonate.

H. Any of the preferred compositions wherein the component (ii) is selected from the group consisting of metals, ammonium or organic bases and partially or completely esterified with mono-, di- or polyalcohols.

I. Any of the preferred compositions wherein the component (ii) is selected from the group consisting of disaccharides, ethylene and propylene glycol, polyethylene and propylene glycols with a molecular weight between 200 and 6000, ethylene, propylene and butylene glycol ethers, paraffinic hydrocarbons with a carbon chain of between 8 and 30 carbon atoms and mono-, di- or trialcohols with a carbon chain of 1–18 atoms.

What already is said shows that the objectives noted in the introduction herein are fulfilled by the detergent compositions according to the invention in all respects but item 2. The following report of experimental results shows that this requirement is also fulfilled by these detergents. In the following examples the surface active agent I is a fatty alcohol polyglycol ether with an average chain length of 17 C-atoms and an average of 10 moles of ethylene oxide; surface active agent II is a fatty alcohol polyglycol ether with an average chain length of 16 C-atoms and an average of 20 moles of ethylene oxide; surface active agent III is a fatty alcohol polyglycol ether with an average chain length of 17 C-atoms and an average of 9 moles of ethylene oxide; surface active agent IV is a fatty alcohol polyglycol ether with an average chain length of 16 C-atoms and an average of 9 moles of ethylene oxide; and surface active agent V is a fatty alcohol polyglycol ether with an average chain length of 16 C-atoms and an average of 10 moles of ethylene oxide.

WASHING EFFECT MEASUREMENT

Procedure: The experiments are made by washing artificially soiled Krefeld web in a Terg-O-Tometer at 85° C.

Washing solution: 1 liter water

Rinsing: The washing solution is poured off and the pieces of web are rinsed in 1 liter of water during 1 minute. The rinsing is repeated 4 times.

Mechanical energy: 50 rpm

Washing time: 15 min.

Washing material: 4 pieces of Krefeld web, each 50 $cm^2$

Measurements: The reflection is measured before washing and is converted into "blackness" ($K_f$) according to Kubelka-Munk. The measurement is made in an Elrephophotometer, whose standard of whiteness is put at 80% in relation to MgO with filter R46, i.e., wavelength maximum is at 460 mμ. After washing and drying the reflectance is measured again and converted into "blackness" ($K_e$). The % of soil dirt removed is derived as follows:

$$\frac{(K_f - K_e)}{K_f} \times 100$$

EXAMPLE 1

| Detergent composition % | |
|---|---|
| Surface active agent I | 26.8 |
| Polyethylene glycol | 1.9 |
| Phosphoric acid diester of tallow fatty acid alcohol with two moles of ethylene oxide | 1.0 |
| Na-soap of tallow fatty acid | 3.5 |
| Disodium adipate | 26.6 |
| $Na_4$-EDTA | 1.0 |
| Sodium acetate | 9.2 |
| Optical bleaches | 0.38 |
| Magnesium silicate | 0.9 |
| Sodium sulphate | 1.2 |
| Sodium silicate | 3.9 |
| Xylene sulphonate | 3.6 |
| CMC | 1.4 |
| Sodium chloride | 0.7 |
| Percarbamide | 14.4 |
| Water | 2.4 |

The washing effect is drastically lowered when a synthetic anionic surface active agent is added. It is less influenced by the addition of soap. The % "blackness" washed away at 5 g/l by

| | | |
|---|---|---|
| Detergent as above | | 80 |
| " | +0.5 g sodium soap of tallow fatty acid | 77.6 |
| " | +0.5 g alkane sulphonate | 68.3 |

EXAMPLE 2

Detergent:

Detergent A: Commercial phosphate based powder with nonionic surface active agents.
B: Commercial NTA based powder.
C: Commercial phosphate based powder with a mixture of nonionic, synthetic anionic surface active agents and soap.
D: Commercial Na-citrate based powder.
E: Detergent Composition

| | % |
|---|---|
| Surface active agent II | 23.2 |
| Glycol ether | 4.6 |
| Disodium adipate | 29.4 |
| Sodium acetate | 15.5 |
| $Na_4$-EDTA | 1.1 |
| Magnesium silicate | 1.0 |
| CMC | 1.7 |
| Sodium chloride | 0.8 |
| Xylene sulphonate | 1.6 |
| Optical bleaches | 0.5 |
| Percarbamide | 11.0 |
| Urea | 4.0 |
| Water | 2.9 |
| Perfume | 0.1 |

The washing effect is strongly lowered by the addition of $Ca^{2+}$ and/or $Mg^{2+}$-ions to a solution of a conventional detergent, but is not influenced if the detergent according to the invention is used. The % "blackness" washed away at 4 g/l by —

| | At 4.5° dH* | At 20° dh |
|---|---|---|
| Detergent A | 85.1 | 69.7 |
| Detergent B | 82.1 | 77.2 |
| Detergent C | 81.1 | 77.1 |
| Detergent D | 68.0 | 64.0 |

-continued

| | At 4.5° dH* | At 20° dh |
|---|---|---|
| Detergent E | 86.5 | 86.8 |

*A measure of water hardness, 0.056 dH = 1 part per million

DETERMINATION OF ASH CONTENT

The determination of ash was made in a Terg-O-Tometer. The washing material has been clean cotton pieces. In each experiment 3 pieces each about 150 $cm^2$ have been used. The following applied for each experiment:

| | |
|---|---|
| Amount of water: | 1 liter |
| Water hardness: | 20° dH |
| Amount of detergent: | 7 g/l |
| Temperature: | 85° C. |

Procedure:

Detergent and water at a temperature of about 20° C. are mixed. When the detergent is dissolved, the test pieces are added. The washing solutions are heated to 85° C. during about 10 minutes. The test pieces are then washed in the Terg-O-Tometer at a mechanical energy of 50 rpm during 5 minutes. After the washing, 800 ml of the washing water is poured off and replaced by 800 ml water of 20° C. and the same hardness, and the Terg-O-Tometer is run for 1 minute. 800 ml of the rinsing water is then replaced by 800 ml water of 20° C. and the Terg-O-Tometer is run again for 1 minute. The rinsing program with dilution and running for 1 minute and so on is repeated 4 times in all. After the last rinsing the test pieces are dried at room temperature, after which the washing-rinsing operation as above is repeated. In all 10 washing-rinsing operations are run. After the last rinsing, the pieces are dried at 90° C. for 2 hours, after which they are allowed to cool in a desiccator armed with silicagel. The pieces are weighed and incinerated at 800° C. The proportion of ashes is determined by—

$$\frac{V_e}{V_f} \times 100 = \% \text{ ash}$$

The proportion of ash according to this method should not exceed 0.5% for commercial detergents.

EXAMPLE 3

| | % Ash |
|---|---|
| Detergent according to Example 1 | 0.02 |
| 95% detergent according to Example 1 + 5% sodium silicate ($SiO_2/Na_2O$ = 3.2) | 0.76 |

EXAMPLE 4

| | |
|---|---|
| Detergent according to Example 2 | 0.30 |
| Detergent according to Example 2 but the percarbamide is replaced by sodium perborate | 0.58 |
| Detergent according to Example 2 but the percarbamide is replaced by percarbonate | 1.44 |

EXAMPLE 5

| Detergent composition % | |
|---|---|
| Surface active agent IV | 19.7 |
| Na-soap of tallow fatty acid | 4.3 |
| Glycol ether | 4.8 |
| Disodium adipate | 30.8 |
| CMC | 1.8 |
| Sodium chloride | 0.9 |
| Sodium acetate | 16.2 |
| $Na_4$-EDTA | 1.1 |
| Magnesium silicate | 1.1 |
| Optical bleaches | 0.45 |
| Xylene sulphonate | 1.7 |
| Percarbamide | 11.5 |
| Colloidal $SiO_2$ | 1.5 |
| Water | 2.6 |
| Perfume | 0.1 |

| | % ash |
|---|---|
| Detergent according to Example 5 | 0.3 |
| 97.5% detergent according to Example 5 + 2.5% sodium metasilicate | 1.6 |
| 95% detergent according to Example 5 + 5% sodium metasilicate | 2.1 |
| 82.5% detergent according to Example 5 + 12.5% $Na_2SO_4$ | 0.32 |
| 70% detergent according to Example 5 + 30% $Na_2SO_4$ | 0.38 |

EXAMPLE 6

| Detergent composition % | |
|---|---|
| Surface active agent IV | 19.1 |
| Na-soap of tallow fatty acid | 4.0 |
| Glycol ether | 4.6 |
| Sodium acetate | 20.6 |
| $Na_4$-EDTA | 1.1 |
| Sodium sulphate | 1.5 |
| Magnesium silicate | 1.0 |
| CMC | 1.7 |
| Sodium chloride | 0.8 |
| Xylene sulphonate | 1.6 |
| Optical bleaches | 0.39 |
| Colloidal silica | 1.5 |
| Percarbamide | 11.0 |
| Water | 1.8 |
| Perfume | 0.1 |
| Na-salt of carbonic acids as below | 29.2 |

| Detergent according to Example 6 | | % ash |
|---|---|---|
| with Na-Salt of the carbonic acid | adipic acid | 0.4 |
| " | maleic acid | 0.2 |
| " | succinic acid | 0.4 |
| " | tartaric acid | 0.4 |
| " | o-phthalic acid | 0.5 |
| " | sebacic acid | 0.4 |

EXAMPLE 7

| Detergent composition %: | |
|---|---|
| Surface active agent IV | 22.1 |
| Glycol ether | 5.5 |
| Disodium adipate | 34.6 |
| $Na_4$-EDTA | 1.3 |
| Sodium acetate | 18.2 |
| Optical bleaches | 0.7 |
| Magnesium silicate | 1.2 |
| Sodium sulphate | 1.7 |
| CMC | 2.0 |
| Sodium chloride | 1.0 |
| Polyethylene glycol | 4.8 |
| Colloidal silica | 1.0 |
| Xylene sulphonate | 1.9 |

-continued

| Detergent composition %: | |
|---|---|
| Water | 3.9 |
| Perfume | 0.1 |

| | % ash |
|---|---|
| Detergent according to Example 7 | 0.4 |
| 82% detergent according to Example 7 + 18% potassium persulphate | 0.4 |
| 82% detergent according to Example 7 + 18% percarbamide | 0.4 |

DETERMINATION OF CORROSION

Procedure:

Sheet-metal, 0.1 mm thick, made of electrolytic copper respectively brass, 50×100 mm are boiled in ethanol, after which they are rinsed in deionized water. The plates are dried in an oven at 110° C. during 1 hour, after which they are allowed to cool in a desiccator armed with silicagel. The plates are then weighed with a precision of 0.1 mg and put into a circular holder made of stainless steel SS 316. Two plates are put into each holder at a distance of 10 cm and a distance to the center of the holder of 5 cm. The holder is immersed into a water solution of the detergent. The water solution is heated during 15 minutes to 85° C. The holder with the plates is then rotated, still immersed in the detergent solution, at a rate of 210 rpm during 30 minutes. The temperature of the detergent solution is kept at 85°±3° C. during the rotation. After the plates have been rotated for 30 minutes they are rinsed in deionized water, dried and weighed in the same way as before the treatment. The result is given as loss of weight in $mg/dm^2$. The concentration of the tested powder has been 7 g/l during the tests. The water hardness has been 4.5° dH.

EXAMPLE 8

| | Corrosion $mg/dm^2$ | |
|---|---|---|
| | Copper | Brass |
| Detergent A according to Example 2 | 18 | 25 |
| Detergent B according to Example 2 | 2 | 6 |
| Detergent C according to Example 2 | 5 | 5 |
| Detergent D according to Example 2 | 4 | 10 |
| Detergent according to Example 7 | 1 | 2 |

The following examples of compositions further illustrate the invention:

EXAMPLE 9

| Liquid detergent composition % | |
|---|---|
| Surface active agent I | 15 |
| Disodium adipate | 12 |
| Ethanol | 20 |
| Optical bleaches | 0.5 |
| Water | 50 |
| Perfume | 0.5 |
| Polyvinylpyrrolidone | 2 |

EXAMPLE 10

| Liquid detergent composition % | |
|---|---|
| Surface active agent III | 25 |
| Dimethyl adipate | 9 |
| Polyethylene glycol | 11 |

-continued

| Liquid detergent composition % | |
|---|---|
| Ethoxylated alkylolamide | 6 |
| Optical bleaches | 0.35 |
| Polyvinylpyrrolidone | 1.65 |
| Ethanol | 46.5 |
| Perfume | 0.5 |

EXAMPLE 11

| Liquid cleaning agent composition % | |
|---|---|
| Surface active agent V | 7 |
| Alkylolamide | 2 |
| Sodium acetate | 3 |
| Disodium succinate | 5 |
| Ammonia | 0.2 |
| Isopropyl alcohol | 9 |
| Perfume | 0.1 |
| Water | 73.7 |

EXAMPLE 12

| Liquid dishwashing agent composition % | |
|---|---|
| Surface active agent IV | 20.0 |
| Ethoxylated alkylolamide | 10.0 |
| Amine oxide | 4.5 |
| Disodium itaconate | 3.0 |
| Ethanol | 15.0 |
| Perfume | 0.3 |
| Colour | 0.01 |
| Water | 47.19 |

EXAMPLE 13

| Machine dishwashing agent composition % | |
|---|---|
| Pluronic L 62 | 0.5 |
| Disodium maleate | 30.5 |
| Disodium tartrate | 46.0 |
| Sodium acetate | 20.0 |
| Potassium dishloroisocyanurate | 2.0 |
| CMC | 1.0 |

EXAMPLE 14

| Detergent composition % | |
|---|---|
| Ethoxylated tallow fatty acid with an average of 10 moles of ethylene oxide per mole of fatty acid | 21.3 |
| Distearyl dimethyl ammonium chloride | 3.1 |
| Triethanolamine soap of tallow fatty acid | 0.7 |
| Sodium propionate | 21.5 |
| Disodium adipate | 26.5 |
| $Na_4$-EDTA | 1.1 |
| Sodium sulphate | 1.5 |
| Magnesium silicate | 1.0 |
| CMC | 1.5 |
| Sodium chloride | 0.7 |
| Optical bleaches | 0.4 |
| Colloidal silica | 2.0 |
| Ammonium persulphate | 15.0 |
| Perfume | 0.2 |
| Water | 3.5 |

We claim:

1. A detergent composition substantially free from carbonates and other components which when said detergent composition is dissolved in water precipitate or sequester the calcium or magnesium in said water and containing between 0 and 3.9% of sodium silicate, and further containing as the essential active detergent component a mixture consisting essentially of (i) between 5% and 30% by weight of said detergent composition of a non-ionic surface active agent selected from the group consisting of the long chain fatty alcohols having 12–20 carbon atoms and carboxylic acids having 12–20 carbon atoms condensed with 8–30 moles of propylene and/or ethylene oxide, and (ii) between 10% and 65% of a builder selected from the group consisting of alkali metal salts of carboxylic acids containing 2–12 carbon atoms said carboxylic acids including a major portion of dicarboxylic acids selected from the group consisting of the sodium salt of o-phthalic acid, and of itaconic acid.

2. The detergent composition of claim 1 wherein said non-ionic surface active agent (i) is selected from the group consisting of fatty alcohol polyglycol ethers condensed with ethylene oxide containing 12–20 carbon atoms in the alcohol chain and between 8 and 30 moles of ethylene oxide.

3. The detergent composition of claim 2 containing between 10% and 20% of percarbamide.

4. The detergent composition of claim 1 containing between 10% and 20% of percarbamide.

5. The composition of claim 1 which also contains up to 50% of a bleaching agent.

6. The composition of claim 1 which also contains up to 50% of an anti-redeposition agent.

7. The composition of claim 1 which also contains up to 50% of an optical bleach.

8. The composition of claim 1 which also contains up to 50% of a peroxide stabilizer.

9. The composition of claim 1 which also contains up to 50% of an accelerator.

10. The composition of claim 1 which also contains up to 50% of an enzyme.

11. The detergent composition of claim 1 wherein said alkali metal salt is the sodium salt of o-phthalic acid.

12. The detergent composition of claim 11 consisting essentially of between about 15% and 30% of said non-ionic surface active agent, and between about 20% and 50% of said carboxylic acid salts.

13. The detergent composition of claim 1 wherein said alkali metal salt is the sodium salt of itaconic acid.

14. The detergent composition of claim 13 consisting essentially of between about 15% and 30% of said non-ionic surface active agent, and between about 20% and 50% of said carboxylic acid salts.

15. The detergent composition of claim 1 consisting essentially of between about 15% and 30% of said non-ionic surface active agent, and between about 20% and 50% of said carboxylic acid salts.

16. The composition of claim 1 wherein said composition is a solid admixture of between about 15% and 30% of said surface active agent, and between about 20% and 50% of said carboxylic acid salts.

17. The composition of claim 16 wherein said surface active agent contains an average of between 16 and 17 carbon atoms in the alcohol chain and an average of between 9 and 20 moles of ethylene oxide, and wherein said carboxylic acid salt includes a major portion of a dicarboxylic acid salt containing 4–10 carbon atoms.

18. The composition of claim 17 containing between about 10% and 20% of percarbamate.

19. The composition of claim 11 wherein said composition is a liquid detergent and contains as the major active components, between about 5% and 25% of a fatty alcohol polyglycol ether condensed with ethylene oxide containing 12–20 carbon atoms in the alcohol chain and between 8 and 30 moles of ethylene oxide.

20. The composition of claim 19 containing between about 2% and 10% of an alkylolamide.

21. The detergent composition of claim 1 containing at least one of the compounds selected from the group consisting of ethylene and propylene glycol, polyethylene and propylene glycols with a molecular weight between 200 and 6000, ethylene, propylene and butylene glycol ethers, and paraffinic hydrocarbons with a carbon chain of between 8 and 30 carbon atoms.

22. A detergent composition consisting of

| | % |
|---|---|
| fatty alcohol polyglycol ether with an average chain length of 17 C-atoms and an average of 10 moles of ethylene oxide | 26.8 |
| polyethylene glycol | 1.9 |
| phosphoric acid diester of tallow fatty acid alcohol with two moles of ethylene oxide | 1.0 |
| Na-soap of tallow fatty acid | 3.5 |
| disodium adipate | 26.6 |
| tetrasodium-ethylenediaminetetraacetic acid | 1.0 |
| sodium acetate | 9.2 |
| optical bleaches | 0.389 |
| magnesium silicate | 0.9 |
| sodium sulphate | 1.2 |
| sodium silicate | 3.9 |
| xylene sulphonate | 3.6 |
| carboxymethycellulose | 1.4 |
| sodium chloride | 0.7 |
| percarbamide | 14.4 |
| water | 2.4 . |

23. A detergent composition consisting of

| | % |
|---|---|
| fatty alcohol polyglycol ether with an average chain length of 16 C-atoms and an average of 20 moles of ethylene oxide | 23.2 |
| glycol ether | 4.6 |
| disodium adipate | 29.4 |
| sodium acetate | 15.5 |
| tetrasodium-ethylenediaminetetraacetic acid | 1.1 |
| magnesium silicate | 1.0 |
| carboxymethylcellulose | 1.7 |
| sodium chloride | 0.8 |
| xylene sulphonate | 1.6 |
| optical bleaches | 0.5 |
| percarbamide | 11.0 |
| urea | 4.0 |
| water | 2.9 |
| perfume | 0.1 . |

24. A detergent composition consisting of

| | % |
|---|---|
| fatty alcohol polyglycol ether with an average chain length of 16 C-atoms and an average of 9 moles of ethylene oxide | 19.7 |
| Na-soap of tallow fatty acid | 4.3 |
| glycol ether | 4.8 |
| disodium adipate | 30.8 |
| carboxymethylcellulose | 1.8 |
| sodium chloride | 0.9 |
| sodium acetate | 16.2 |
| tetrasodium-ethylenediaminetetraacetic acid | 1.1 |
| magnesium silicate | 1.1 |
| optical bleaches | 0.45 |
| xylene sulphonate | 1.7 |
| percarbamide | 11.5 |
| colloidal $SiO_2$ | 1.5 |
| water | 2.6 |
| perfume | 0.1 . |

25. A detergent composition consisting of

| | % |
|---|---|
| fatty alcohol polyglycol ether with an average chain length of 16 C-atoms and an average of 9 moles of ethylene oxide | 19.1 |
| Na-soap of tallow fatty acid | 4.0 |
| glycol ether | 4.6 |
| sodium acetate | 20.6 |
| tetrasodium-ethylenediaminetetraacetic acid | 1.1 |
| sodium sulphate | 1.5 |
| magnesium silicate | 1.0 |
| carboxymethylcellulose | 1.7 |
| sodium chloride | 0.8 |
| xylene sulphonate | 1.6 |
| optical bleaches | 0.39 |
| colloidal silica | 1.5 |
| percarbamide | 11.0 |
| water | 1.8 |
| perfume | 0.1 |
| Na-salt of adipic acid; succinic acid; o-phthalic acid, or sebacic acid | 29.2 . |

26. A detergent composition consisting of

| | % |
|---|---|
| fatty alcohol polyglycol ether with an average chain length of 16 C-atoms and an average of 9 moles of ethylene oxide | 22.1 |
| glycol ether | 5.5 |
| disodium adipate | 34.6 |
| tetrasodium-ethylenediaminetetraacetic acid | 1.3 |
| sodium acetate | 18.2 |
| optical bleaches | 0.7 |
| magnesium silicate | 1.2 |
| sodium sulphate | 1.7 |
| carboxymethylcellulose | 2.0 |
| sodium chloride | 1.0 |
| polyethylene glycol | 4.8 |
| colloidal silica | 1.0 |
| xylene sulphonate | 1.9 |
| water | 3.9 |
| perfume | 0.1 . |

27. A detergent composition consisting of

| | % |
|---|---|
| fatty alcohol polyglycol ether with an average chain length of 17 C-atoms and an average of 10 moles of ethylene oxide | 15 |
| disodium adipate | 12 |

-continued

| | % |
|---|---|
| ethanol | 20 |
| optical bleaches | 0.5 |
| water | 50 |
| perfume | 0.5 |
| polyvinylpyrrolidone | 2 . |

28. A detergent composition consisting of

| | % |
|---|---|
| fatty alcohol polyglycol ether with an average chain length of 17 C-atoms and an average of 9 moles of ethylene oxide | 25 |
| dimethyl adipate | 9 |
| polyethylene glycol | 11 |
| ethoxylated alkylolamide | 6 |
| optical bleaches | 0.35 |
| polyvinylpyrrolidone | 1.65 |
| ethanol | 46.5 |
| perfume | 0.5 . |

29. A detergent composition consisting of

| | % |
|---|---|
| fatty alcohol polyglycol ether with an average chain length of 16 C-atoms and an average of 10 moles of ethylene oxide | 7 |
| alkylolamide | 2 |
| sodium acetate | 3 |
| disodium succinate | 5 |
| ammonia | 0.2 |
| isopropyl alcohol | 9 |
| perfume | 0.1 |

-continued

| | % |
|---|---|
| water | 73.7 . |

30. A detergent composition consisting of

| | % |
|---|---|
| fatty alcohol polyglycol ether with an average chain length of 16 C-atoms and an average of 9 moles of ethylene oxide | 20.0 |
| ethoxylated alkylolamide | 10.0 |
| amine oxide | 4.5 |
| disodium itaconate | 3.0 |
| ethanol | 15.0 |
| perfume | 0.3 |
| colour | 0.01 |
| water | 47.19 . |

31. A detergent composition consisting of

| | % |
|---|---|
| ethoxylated tallow fatty acid with an average of 10 moles of ethylene oxide per mole of fatty acid | 21.3 |
| distearyl dimethyl ammonium chloride | 3.1 |
| triethanolamine soap of tallow fatty acid | 0.7 |
| sodium propionate | 21.5 |
| disodium adipate | 26.5 |
| tetrasodium-ethylenediaminetetraacetic acid | 1.1 |
| Sodium sulphate | 1.5 |
| magnesium silicate | 1.0 |
| carboxymethylcellulose | 1.5 |
| sodium chloride | 0.7 |
| optical bleaches | 0.4 |
| collodial silica | 2.0 |
| ammonium persulphate | 15.0 |
| perfume | 0.2 |
| water | 3.5 . |

* * * * *

UNITED STATES PATENT AND TRADEMARK OFFICE

CERTIFICATE OF CORRECTION

PATENT NO. : 4,252,663

DATED : February 24, 1981

INVENTOR(S) : Georg T. ERIKSSON

It is certified that error appears in the above—identified patent and that said Letters Patent is hereby corrected as shown below:

Column 10, between line 42 and the formula which appears on line 45, insert the following --Weight before incineration = $V_f$ Weight after incineration = $V_e$ --.

Column 15, line 5 (Claim 19): after "claim" delete "11" and insert --1--.

Signed and Sealed this

First Day of March 1983

[SEAL]

Attest:

GERALD J. MOSSINGHOFF

Attesting Officer

Commissioner of Patents and Trademarks